US011174128B2

(12) United States Patent
Hsu et al.

(10) Patent No.: US 11,174,128 B2
(45) Date of Patent: Nov. 16, 2021

(54) ELEVATOR DOOR CONTROL FOR DEBOARDING PASSENGERS IN MULTI-DOOR ELEVATORS

(71) Applicant: Otis Elevator Company, Farmington, CT (US)

(72) Inventors: Arthur Hsu, South Glastonbury, CT (US); Tadeusz Pawel Witczak, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 699 days.

(21) Appl. No.: 16/050,073

(22) Filed: Jul. 31, 2018

(65) Prior Publication Data

US 2020/0039795 A1 Feb. 6, 2020

(51) Int. Cl.

*B66B 13/14* (2006.01)
*B66B 5/00* (2006.01)
*B66B 13/08* (2006.01)

(52) U.S. Cl.

CPC ..... *B66B 13/146* (2013.01); *B66B 5/0006* (2013.01); *B66B 13/08* (2013.01)

(58) Field of Classification Search

CPC ..... B66B 13/146; B66B 5/0006; B66B 13/08
See application file for complete search history.

(56) References Cited

U.S. PATENT DOCUMENTS 5,300,739 A 4/1994 Bittar
6,945,365 B2 9/2005 Matela
7,296,662 B1 11/2007 Fargo
2016/0289043 A1 10/2016 Fang et al.
2017/0190544 A1* 7/2017 Witczak ..... B66B 1/2466
2017/0267487 A1 9/2017 Pasini et al.
(Continued)

FOREIGN PATENT DOCUMENTS

CN 101746649 A 6/2010
CN 104030114 A 9/2014
CN 104071655 A 10/2014
(Continued)

OTHER PUBLICATIONS

Extended European Search Report for Application No. 19189316.3-1017, dated Dec. 17, 2019, 9 pages.
(Continued)

*Primary Examiner* — Jeffrey Donels
(74) *Attorney, Agent, or Firm* — Cantor Colburn LLP

(57) ABSTRACT

Embodiments include a system and method for controlling doors in a multi-door system. Embodiments a controller configured to control the multi-door system, wherein the multi-door system includes a first door and a second door, wherein the first door is on a different side than the second door, and one or more sensors operably coupled to the multi-door system and the controller, wherein the one or more sensors are configured to detect one or more conditions. The controller includes a processor, wherein the processor is configured to receive an input from the one or more sensors, wherein the input comprises at least one of call information and crowd sensing information, responsive to the input, prioritize an operation of the first door and the second door based at least in part on the input, and operate the first door and second door based on the prioritization.

18 Claims, 5 Drawing Sheets

(56) References Cited

U.S. PATENT DOCUMENTS

| | | | | |
|---|---|---|---|---|
| 2017/0355557 | A1 | 12/2017 | Witczak et al. | |
| 2019/0322490 | A1* | 10/2019 | Hovi | B66B 13/08 |

FOREIGN PATENT DOCUMENTS

| | | | |
|---|---|---|---|
| CN | 204897122 | U | 12/2015 |
| CN | 107055231 | A | 8/2017 |
| CN | 107200245 | A | 9/2017 |
| CN | 107473035 | A | 12/2017 |
| CN | 206985488 | U | 2/2018 |
| EP | 1483190 | A1 | 12/2004 |
| EP | 2876610 | A1 | 5/2015 |
| EP | 3187447 | A1 | 7/2017 |
| JP | 406234469 | A | 8/1994 |
| JP | 2001151445 | A | 6/2001 |
| JP | 2007119101 | A | 5/2007 |
| JP | 2009161343 | A | 7/2009 |
| JP | 2009215013 | A | 9/2009 |
| JP | 2009249157 | A | 10/2009 |
| JP | 2012148876 | A | 8/2012 |
| JP | 2012180181 | A | 9/2012 |
| JP | 2016128356 | A | 7/2016 |
| WO | 03074405 | A1 | 9/2003 |
| WO | 2013033879 | A1 | 3/2013 |
| WO | 2014111127 | A1 | 7/2014 |
| WO | 2016135114 | A1 | 9/2016 |
| WO | 2016146357 | A1 | 9/2016 |

OTHER PUBLICATIONS

"TTC Dual Entrance Car", Kone Elevator Glossary, < https://toolbox.kone.com/media/en_CN/toolbox_files/accessories/tc_8001ef4a.html > Jun. 6, 2018, 1 page.

Office Action for Chinese Application No. 201910694572.7 dated Jun. 28, 2021.

* cited by examiner

ELEVATOR DOOR CONTROL FOR DEBOARDING PASSENGERS IN MULTI-DOOR ELEVATORS

BACKGROUND

The present disclosure relates generally to multi-door systems, and more particularly to controlling elevator doors for deboarding passengers in multi-door elevators.

In some configurations, elevators are equipped with one or more doors to allow passengers to enter and exit the elevator car. For example, elevators may have a forward entrance and a rear entrance that are accessible to the same landing floor. In other configurations, the rear entrance may not be accessible on every floor or the rear entrance may be restricted to authorized personnel. Oftentimes as passengers deboard the elevator, they face crowds of awaiting passengers that are eager to enter the elevator car. There is a need to manage the flow of passengers exiting an elevator to alleviate the congestion of people in areas surrounding the elevator entrance and lobby area.

BRIEF SUMMARY

According to an embodiment, a system for controlling doors in a multi-door system is provided. The system includes a multi-door system, and a system controller configured to control the multi-door system, wherein the multi-door system includes a first door and a second door, wherein the first door is on a different side than the second door. The system also includes one or more sensors operably coupled to the multi-door system and the system controller, wherein the one or more sensors are configured to detect one or more conditions. The system controller includes a processor, wherein the processor is configured to receive an input from the one or more sensors, wherein the input comprises at least one of call information and crowd sensing information, responsive to the input, prioritize an operation of the first door and the second door based at least in part on the input, and operate the first door and second door based on the prioritization.

In addition to one or more of the features described herein, or as an alternative, further embodiments include an elevator system.

In addition to one or more of the features described herein, or as an alternative, further embodiments include landing crowd sensing information and elevator crowd sensing information.

In addition to one or more of the features described herein, or as an alternative, further embodiments include hall calls or car calls indicating at least one of a floor selection or a door preference indicating a first or second side of the multi-door system.

In addition to one or more of the features described herein, or as an alternative, further embodiments include landing crowd sensing information that indicates a crowd size on a first side and a second side of the multi-door system and the elevator crowd sensing information indicates a number of passengers present in an elevator car.

In addition to one or more of the features described herein, or as an alternative, further embodiments include a second multi-door system, wherein the second multi-door system is proximate to a first multi-door system, and wherein the processor is configured to prioritize operation of the first door and the second door of the first multi-door system based on an input of the second multi-door system.

In addition to one or more of the features described herein, or as an alternative, further embodiments include one or more sensors that monitor an area common to the first multi-door system and the proximate multi-door system.

In addition to one or more of the features described herein, or as an alternative, further embodiments include at least one of a display unit or audio unit to provide an indication of a first door to be opened.

According to another embodiment, a method for controlling doors in a multi-door system is provided. The method includes receiving an input from one or more sensors, and responsive to the input, comparing a condition associated with a first door and a condition associated with a second door of a multi-door system. The method also includes prioritizing an operation of the first door and the second door based at least in part on the comparison, and operating the first door and second door based on the prioritization.

In addition to one or more of the features described herein, or as an alternative, further embodiments include an elevator system.

In addition to one or more of the features described herein, or as an alternative, further embodiments include opening a subsequent door after a configurable delay responsive to operating a first door.

In addition to one or more of the features described herein, or as an alternative, further embodiments include opening a subsequent door based at least in part on a detected load in the multi-door system.

In addition to one or more of the features described herein, or as an alternative, further embodiments include opening a subsequent door responsive to closing a first door.

In addition to one or more of the features described herein, or as an alternative, further embodiments include opening a subsequent door based at least in part on a number of elevator calls for a side of the multi-door system.

In addition to one or more of the features described herein, or as an alternative, further embodiments include opening a subsequent door based at least in part on a crowd size inside the multi-door system.

In addition to one or more of the features described herein, or as an alternative, further embodiments include providing an indication of a first door to be opened inside of the multi-door system, wherein the indication is at least one of an audio indication or a visual indication.

In addition to one or more of the features described herein, or as an alternative, further embodiments include call information and crowd sensing information, wherein the call information indicates a floor selection and a door preference indicating a first or second side of the multi-door system, wherein the crowd sensing information comprises landing crowd sensing information and elevator crowd sensing information.

In addition to one or more of the features described herein, or as an alternative, further embodiments include determining a crowd size of a proximate multi-door system, and operating the first door and the second door of a first multi-door system based on the crowd size of the proximate multi-door system.

In addition to one or more of the features described herein, or as an alternative, further embodiments include a configurable delay that is determined by at one of a fixed delay, landing crowd sensing information, or elevator crowd sensing information.

In addition to one or more of the features described herein, or as an alternative, further embodiments include a threshold number of passengers in an elevator car is determined by an image capture device configured to perform a crowd estimation or a load sensor configured to detect a weight of passengers in the elevator car.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Elevators provide a convenient means for transporting people and cargo between floors of a building. However, passengers that are waiting to board an elevator can be a source of congestion in elevator lobby areas or hallways. In elevator systems having a single set of doors for entering and exiting, passengers may attempt to board the elevator before allowing those passengers in the elevator to exit, contributing to the formation of crowds in areas proximate the elevator doors.

The techniques described herein provide a mechanism to prioritize the opening of multiple doors of an elevator to manage the flow of exiting passengers. In one or more embodiments, the elevator doors are opened based on the number of detected passengers gathered at the entrance of an elevator. For example, the side of the elevator having the least number of waiting passengers or the smallest crowd will be opened first to allow the passengers in the elevator to exit on the least crowded side first. Subsequently, the other door can be opened to allow the remaining passengers to exit the elevator after a portion of the passengers has already deboarded. The second or subsequent door can be opened based on a configurable time delay or based on data indicating the weight/pressure of the elevator car. This data can be used to indicate how many passengers are remaining in the elevator car which can be used to trigger the other door to open when a threshold level of people are estimated to have exited.

In one or more embodiments, an indication is provided inside the elevator car to notify the passengers which door will be opening first. This indication can be provided to the passengers prior to reaching the destination in order to help the passengers smoothly transition to exit the elevator. The indication can be a visual and/or an audible indication to help prepare the passengers to deboard.

In one or more embodiments, various sensors can be used to determine the number of waiting passengers which provides feedback on which side the door of the multi-door system should be opened first to encourage the traffic flow out of the elevator. For example, cameras can be configured to detect a crowd size on both sides of an elevator having two doors. In another example, information indicating which side of the elevator a call is received (indicating a waiting passenger) can be used to estimate the crowd on a particular side. In addition, the detected crowd size of a neighboring elevator can be used to determine the first door to open because the neighboring crowd can impact the passengers that are exiting a given elevator.

The techniques described herein leverage the tendency for passengers to exit the first door to open. In addition, the techniques include prioritizing the sequence of operating the doors and synchronizing the opening of a subsequent door in the multi-door system to aid in traffic flow and reduce congestion in areas surrounding the elevators.

Figure 1:
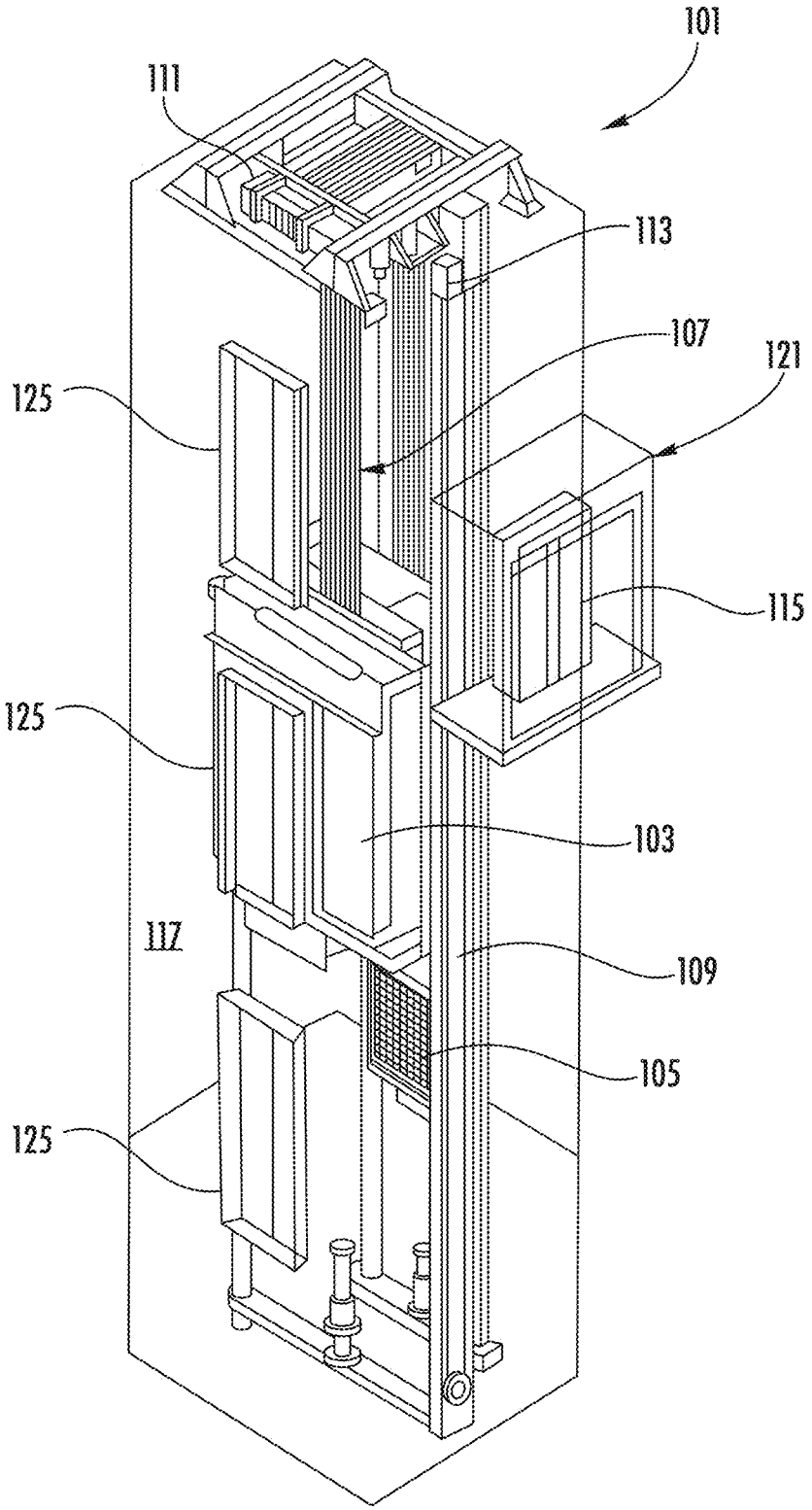
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators, people movers, etc. Accordingly, embodiments described herein are not limited to elevator systems, such as that shown in FIG. 1.

Figure 2:
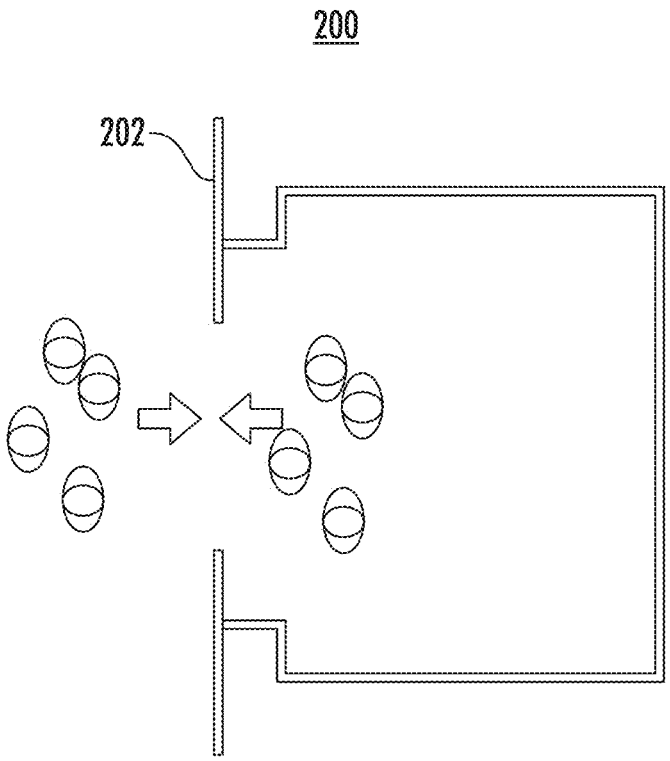
FIG. 2 depicts an elevator landing traffic flow of an elevator system.

In FIG. 2, an elevator system 200 having a single door 202 is shown. As shown in FIG. 2 the elevator doors are opened upon reaching the destination floor. After the doors are opened the passengers inside the elevator will make their way to exit the elevator and into the lobby or landing floor. Oftentimes passengers are waiting outside of the elevator 200 and may be an obstacle to those passengers attempting to exit the elevator 200. Additionally, sometimes those passengers that are waiting to board the elevator 200 will enter the elevator 200 before allowing the passengers that are currently in the elevator 200 to deboard. This scenario can lead to congestion in the area surrounding the elevator doors 202 and inefficient flow of passengers.

Figure 3:
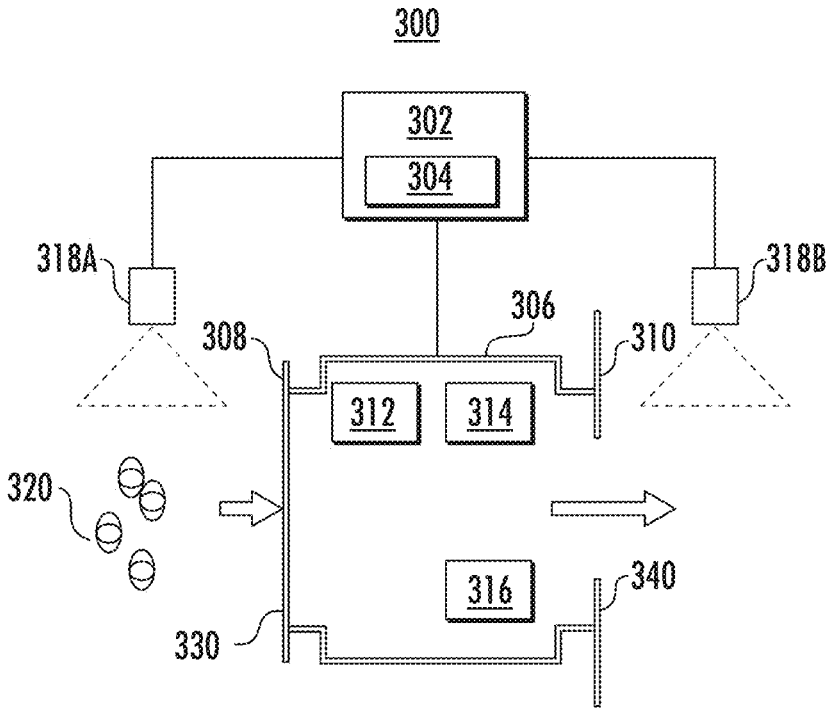
FIG. 3 depicts a system for controlling doors of a multi-door system in accordance with one or more embodiments.

Now referring to FIG. 3, a system 300 having multiple doors in accordance with one or more embodiments is shown. The system 300 includes a controller 302 having a processor 304. In one or more embodiments, the controller 302 is an elevator system controller that is configured to communicate with the elevator 306, sensors, external systems, etc. The controller 302 as shown is operably coupled to the elevator car 306 which has a first door 308 and a second door 310. In one or more embodiments, the controller 302 can be located on the elevator car, a remote or local server, network cloud, etc. The first door 308 can open up to a first side 330 of the elevator car 306 while the second door 310 can open up to a second side 340 of the elevator car 306. The first and second sides 330, 340 of the elevator car 306, although on different sides, provide passengers access to the same floor of the building. Although two doors are shown, it should be understood that different configurations such as the number of doors and position of doors can be used. The elevator car 306 includes a display 312 and audio device 314 for providing notification information to those passengers traveling in the elevator car 306. The notifications can include an indication to the passengers of the door that will be opened first. In other examples, the notification can provide a recommendation to the passengers such as "exit right for least congestion," "fastest exit," etc. The notification can be any type of visual and/or audio indication. The elevator car 306 is also equipped with one or more sensors 316. The sensors 316 can include load sensors (such as pressure sensors, piezo electric sensors, etc.) to determine the weight and/or presence of the passengers of the elevator car 306. In one embodiment, the sensors can be a camera 316 or any other desired type of known imaging device such as a video camera, thermal camera, depth sensor, etc., that is used for crowd detection of the passengers in the elevator car 306. In other embodiments, the sensors can also include passive infrared, RADAR, LIDAR, ultrasonic ranging sensors, acoustic sensors, capacitance sensing and sensing of mobile devices (Bluetooth, NFC, etc.). The sensors 316, whether by a change in weight or by monitoring the number of passengers in the elevator car, can be used to trigger the opening of a subsequent door of the elevator car 306 after a first door is opened.

The system 300 can also include one or more sensors 318A, 318B that are operably coupled to the controller 302 and elevator car 306 located outside of the elevator car 306. The sensors 318A, 318B can include cameras (such as, video camera, thermal camera, depth sensor, etc.) or load sensors (such as pressure or pressure sensors, piezo electric sensors), etc. and can be configured to monitor the respective areas outside of the elevator car 306. For example, the sensor 318A can be used to monitor a crowd size of the first side 330 of the elevator car 306 and the sensor 318B can be used to monitor the other side.

In this non-limiting example, the sensor 318A has determined that a crowd of passengers 320 has formed on the first side 330 of the elevator car 306. Upon reaching the floor the elevator doors 310 which are opposite the side of the crowd 320 are opened first to allow the passengers inside the elevator car 306 to efficiently exit without navigating through the crowd 320. After a delay, the elevator doors 308 can be opened to allow those people in the crowd 320 that desire to board the elevator car 306 to enter. In other embodiments, the elevator doors 308 are opened responsive to a detection by the sensor 316, such as a camera or load sensor in the floor of the elevator car 306, indicating that a configurable threshold number of passengers has deboarded. In one or more embodiments, the delay can be configured in a number of ways. For example, a delay can be configured to be longer on one floor over another floor if it determined that a particular floor is known to have higher traffic such as a lobby. In another embodiment, the delay can be configured based on a number of passengers on the landing that is detected by an image capturing device or a number of elevator calls that have been received. The image capturing device can be coupled to an image processor configured to perform crowd estimation or the image can be processed in a cloud network or some other network or location. Also, the multi-door system can be configured to ensure a sufficient number of passengers on the elevator car have exited the elevator car prior to opening the set of doors facing a large crowd by increasing the delay between opening the first set of doors and the second doors. It should be understood that different delay can be configured based on a number of factors, conditions, etc. In one or more embodiments, the configurable threshold can be an estimated threshold number of passengers detected by an image capturing device or the weight of the passengers of the elevator car detected by a load sensor. The configurable threshold can be a fixed or dynamic threshold that can be determined by an elevator operator. In some embodiments, the elevator door 310 that was opened first will be completely closed prior to opening the elevator door 308.

Figure 4:
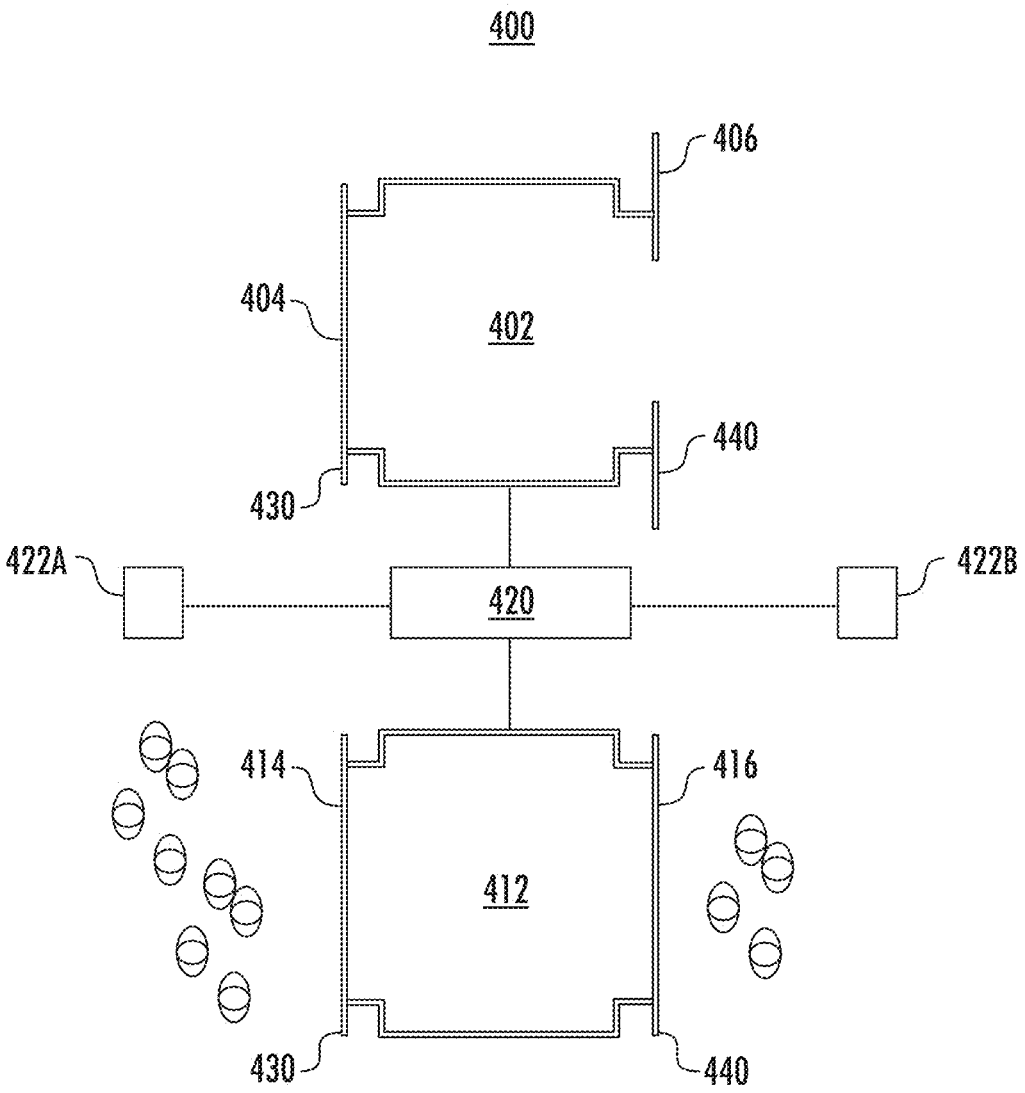
FIG. 4 depicts a configuration of a neighboring elevator in accordance with one or more embodiments.

In FIG. 4, depicts a system 400 including neighboring elevator cars in accordance with one or more embodiments is shown. FIG. 4 depicts a first elevator car 402 and a first door 404 and second door 406 where the first door 404 opens up to a first side 430 of the elevator car 402 and the second door 406 opens up to the second side 440. Although the other components of the elevator car 306 of FIG. 3 are not shown, it should be understood that the elevator car 402 can include a similar configuration. FIG. 4 also shows a second elevator car 412 that includes a first door 414 and a second door 416. The elevator cars 402 and 412 have common areas on respective sides of the elevators cars 402 and 412. Also shown in FIG. 4, a controller 420 is coupled to the first elevator car 402 and second elevator car 412. In a different embodiment, the controller 420 can be a single common controller for the first and second elevator car 402 and 412 or separate controllers configured to communicate with each other. In addition, the controller(s) can be located on the elevator car, a network cloud, a local or remote server, etc. The controller 420 is also coupled to sensors 422A and 422B which can monitor the respective first and second sides 430, 440 of the elevator cars 402 and 412. The sensors 422A and 422B can be configured to monitor areas that are common to both the first elevator car 402 and second elevator car 412. Although only two sensors are shown, any number, configuration, and type of sensor can be used in the system 400. In addition, any number and configuration of neighboring elevator cars can be included in the system 400.

In the non-limiting example shown in FIG. 4, the crowds forming by a neighboring elevator car 412 can be detected by the sensors 422A and 422B and impact the prioritization of opening the doors of the elevator car 402. The doors can be selected to minimize the number of people that congregate outside of the elevator cars 402 and 412. It should be understood that the crowd near the elevator car 402 can be due to some other attraction such as a display, a business, an out-of-service elevator, or any other reason that can lead to crowd congestion. Returning to the example, the sensor 422A has detected a large crowd on a first side 430 of the elevator 412 and the sensor 422B has detected a crowd on a second side 440 of the elevator car 412 that is not as large as the crowd on the first side 430. After the controller 420 performs the comparison the door 406 of the elevator car 402 is selected because the crowd size on that side is not as large and will encourage the efficient flow of passengers out of the elevator car.

Figure 5:
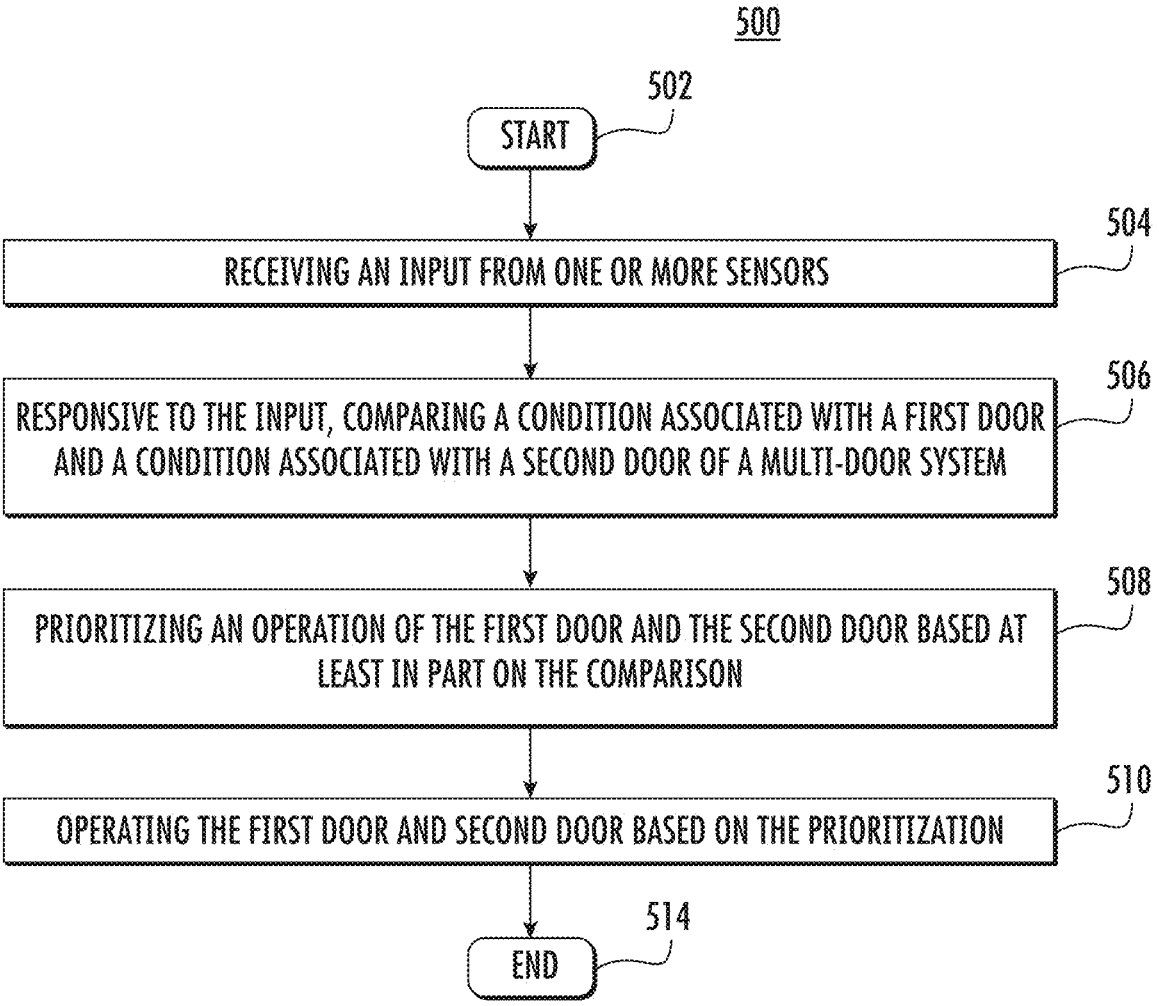
FIG. 5 depicts a flowchart of a method for controlling doors of a multi-door system in accordance with one or more embodiments.

In FIG. 5, a flowchart of a method 500 for controlling doors for deboarding passengers in a multi-door system is shown. The method 500 begins a block 502 and continues to block 504 which provides for receiving an input from one or more sensors. The inputs include call information, landing crowd sensing information and elevator crowd sensing information. The call information includes hall calls and car calls for each door at a given floor. The hall calls correspond to passengers waiting to board an elevator. The direction of the call can be used to indicate potential passengers are waiting to board an elevator car. An elevator heading in the opposition direction of the elevator call may not use the information if it is not the elevator servicing the elevator call.

The car calls correspond to passengers that are deboarding an elevator at a floor. The input can include a crowd detection of passengers on each side of the elevator car. In one or more embodiments, a number of elevator calls that are received for a particular side of the elevator can be used to estimate a crowd of waiting passengers. For example, in some elevator systems a passenger logs in an elevator call at a kiosk where the passenger is either assigned to a particular elevator car and door assignment or the passenger may request a door preference in the elevator car to reach their destination. In one or more embodiments, the choice of the elevator doors is based at least in part on hall calls which indicate that potential passengers are present in front of a particular set of doors.

The method 500 at block 506 provides for comparing a condition associated with a first door and a condition associated with a second door of the unit. In one or more embodiments, a unit is an elevator unit and the condition is the crowd size of people detected outside of the elevator car on a first side and a second side. The crowd size can be detected using cameras that monitor the areas outside of the elevator car. In other embodiments, the crowd size may be estimated based on a number of elevators calls that are associated with a particular side of the elevator car discussed above. This elevator call information can include a floor selection and a door preference which can be used to prioritize the operation of the doors to reduce the crowding outside of the elevator car.

At block 508, the method 500 provides for prioritizing an operation of the first door and the second door based at least in part on the comparison. The operation includes sequencing the opening and closing of the doors of the unit. In one or more embodiments, the first door or the second door is selected to be opened first based on the comparison. For example, if the crowd size is detected to be larger on a first side of the elevator car, the elevator doors on the second side, opposite the first side, will be given first priority and opened first. On the other hand, if the crowd size on the second size is larger, the elevator doors on the first side will receive priority and be opened first.

Subsequently, the other door(s) will be opened to allow the remaining passengers to deboard the elevator car. The operation of the opening of the subsequent door can be operated in a number of ways such opening the doors responsive to a configurable delay, responsive to a load detection or passenger crowd detection, responsive to completely closing the first door, etc. It is to be understood that other configurations can be used to open the subsequent door where the system can be equipped with the appropriate sensors to detect the conditions.

Block 510 provides for operating the first door and second door based on the prioritization. The controller is configured to transmit commands to the elevator car to control the opening and closing of the doors according to the determined crowd size. In one or more embodiments, the method 500 can repeat each time an elevator call is made to select the sequence and operation of opening the doors. The method 500 ends at block 512.

The technical effects and benefits improve passenger flow in the elevator lobby by minimizing interference between boarding and deboarding passengers. This is accomplished by manipulating the door operation of the multi-door system to steer/encourage the passengers to follow an efficient path. The technical effect and benefits also alleviate crowd congestion surrounding the elevator cars.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A system for controlling doors in a multi-door system, the system comprising:

a multi-door system;

a system controller configured to control the multi-door system, wherein the multi-door system includes a first door and a second door, wherein the first door is on a different side than the second door;

one or more sensors operably coupled to the multi-door system and the system controller, wherein the one or more sensors are configured to detect one or more conditions;

the system controller comprises a processor, wherein the processor is configured to:

receive an input from the one or more sensors, wherein the input comprises at least one of call information and crowd sensing information;

responsive to the input, prioritize an operation of the first door and the second door based at least in part on the input; and operate the first door and second door based on the prioritization; and open a subsequent door after a configurable delay responsive to operating the first door.

2. The system of claim 1, wherein the multi-door system is an elevator system.

3. The system of claim 1, wherein the crowd sensing information comprises landing crowd sensing information and elevator crowd sensing information.

4. The system of claim 2, wherein the call information comprises at least one of a hall call or car call indicating at least one of a floor selection or a door preference indicating a first or second side of the multi-door system.

5. The system of claim 3, wherein the landing crowd sensing information indicates a crowd size on a first side and a second side of the multi-door system and the elevator crowd sensing information indicates a number of passengers present in an elevator car.

6. The system of claim 2, further comprising a second multi-door system, wherein the second multi-door system is proximate to a first multi-door system;

wherein the processor is configured to prioritize operation of the first door and the second door of the first multi-door system based on an input of the second multi-door system.

7. The system of claim 6, wherein at least one or more sensors monitor an area common to the first multi-door system and the second multi-door system.

8. The system of claim 1, wherein the multi-door system further comprises at least one of a display unit or audio unit to provide an indication of a first door to be opened.

9. A method for controlling doors in a multi-door system, the method comprising:

receiving an input from one or more sensors;

responsive to the input, comparing a condition associated with a first door and a condition associated with a second door of a multi-door system, wherein the multi-door system is an elevator system;

prioritizing an operation of the first door and the second door based at least in part on the comparison;

operating the first door and second door based on the prioritization; and opening a subsequent door after a configurable delay responsive to operating the first door.

10. The method of claim 9, further comprising opening a subsequent door based at least in part on a detected load in the multi-door system.

11. The method of claim 9, further comprising opening a subsequent door responsive to closing a first door.

12. The method of claim 9, further comprising opening a subsequent door based at least in part on a number of elevator calls for a side of the multi-door system.

13. The method of claim 9, further comprising opening a subsequent door based at least in part on a crowd size inside the multi-door system.

14. The method of claim 9, further comprising providing an indication of a first door to be opened inside of the multi-door system, wherein the indication is at least one of an audio indication or a visual indication.

15. The method of claim 9, wherein the input comprises at least one of a call information and crowd sensing information, wherein the call information indicates a floor selection or a door preference indicating a first or second side of the multi-door system, wherein the crowd sensing information comprises landing crowd sensing information and elevator crowd sensing information.

16. The method of claim 9, further comprising determining a crowd size of a proximate multi-door system, and operating the first door and the second door of a first multi-door system based on the crowd size of a proximate multi-door system.

17. The method of claim 9, wherein the configurable delay is determined by at one of a fixed delay, landing crowd sensing information, or elevator crowd sensing information.

18. The method of claim 17, wherein a threshold number of passengers in an elevator car is determined by an image capture device configured to perform a crowd estimation or a load sensor configured to detect a weight of passengers in the elevator car.

* * * * *